United States Patent [19]

Moore et al.

[11] Patent Number: 4,899,664

[45] Date of Patent: Feb. 13, 1990

[54] SPLIT WORKHEAD

[75] Inventors: Roy J. Moore, Columbia; Calvin L. Coy, Chapin, both of S.C.

[73] Assignee: Tamper Corp., Columbia, S.C.

[21] Appl. No.: 12,608

[22] Filed: Feb. 9, 1987

[51] Int. Cl.[4] ..... E01B 27/12

[52] U.S. Cl. ..... 104/12

[58] Field of Search ..... 104/2, 4, 5, 6, 7.1, 104/7.2, 10, 12

[56] References Cited

U.S. PATENT DOCUMENTS

| | | | |
|---|---|---|---|
| 2,973,719 | 3/1961 | Plasser et al. | 104/12 |
| 3,144,834 | 8/1964 | Stewart . | |
| 3,534,687 | 10/1970 | Plasser et al. . | |
| 4,066,020 | 1/1978 | Theurer . | |
| 4,576,095 | 3/1986 | Theurer . | |

FOREIGN PATENT DOCUMENTS

| | | |
|---|---|---|
| 938498 | 12/1973 | Canada . |
| 1213381 | 1/1968 | United Kingdom . |
| 1337513 | 2/1972 | United Kingdom . |
| 2060035 | 4/1981 | United Kingdom . |

*Primary Examiner*—Johnny D. Cherry
*Assistant Examiner*—F. H. Williams, Jr.
*Attorney, Agent, or Firm*—Wenderoth, Lind & Ponack

[57] ABSTRACT

There is described a track travelling railroad switch tamping machine which has a transversally extending guide frame at its front end and four ballast tamping units one each mounted in individual sub-frames which are mounted on the guide frame. Hydraulic power means are provided to individually move each of the sub-frames with its tamping unit, transversally of the vehicle on the guide frames, independentally of each other sub-frame. Individual hydraulic power devices are provided on each sub-frame for individually raising and lowering each tamping unit within its own sub-frame, independently of the other tamping units.

5 Claims, 4 Drawing Sheets

SPLIT WORKHEAD

BACKGROUND OF THE INVENTION

The present invention relates to machines for tamping railroad track, particularly in switches.

When tamping tangent track, where the spacing of the individual rails of the track is constant, it is necessary only to provide for the up and down movement on the tamping machine of the tamping units into and out of the ballast to be tamped. However, on entering a switch, where two tracks merge the spacing between the rails of the tracks varies and this requires the provision of some means to transversely alter the position of the tamping units relative to the tamping machine frame to accommodate the rail spacing changes.

There have been different solutions proposed to the problem of tamping in switches.

One common solution is the use of pendulum type workheads. Canadian Pat. No. 938,498 is an example of this type of workhead. Here a machine has four independently manoeuvrable tamping workheads pendulously mounted for movement transversely of the track to be tamped. This solution gives a very complete tamping pattern but suffers from one fundamental drawback in that as the workheads are swung, the depth of penetration of the tamping tools in relation to the bottom of the ties to be tamped changes, resulting in non-uniform ballast compaction. This deficiency can be compensated but only with considerable expense and the use of complex technology.

A proposal has been made to overcome the tamping depth problem encountered by the pendulum type of switch tamping machine and in this solution tamping heads are mounted so as to be able to be transversed laterally horizontally of the track on a guide frame. This solution has utilised a conventional tamping head such as that described in U.S. Pat. No. 3,426,697 and whilst this solution overcomes the tamping dept problem, it results in a machine which requires more time to negotiate the switch because the workheads require to be transversed at greater distances than the pendulum type and when the heads are transversed outward completely, as in the frog and switch point areas, they cause some disturbance to the shoulder ballast. Further on rail systems with electrified third rail it is not normally possible to tamp on the outside of the running rails in the areas of the frog and switch point.

Yet another proposal has been made, such as is shown in U.S. Pat. No. 4,576,095 in which again two workheads transverse laterally horizontally of the tamping machine. In this device the two tamping units which make up each of the two workheads have independent vertical movement. This has the advantage that the problem of shoulder ballast disturbance can be reduced or obviated. However this proposal suffers from the drawback that when a wide section of track structure is encountered, a complete tamping pattern is possible only with time consuming traversing of the workheads and frequent operation of the individual tamping unit vertical actuators.

According to the present invention there is provided a railroad switch tamping machine comprising a wheeled rail travelling vehicle; guide frame means extending transversely of the vehicle; four tamping units mounted for horizontal movement in translation and vertical displacement on the guide frame means; means for individually raising and lowering each of the four tamping units relative to each other tamping unit; and means for individually moving each of the four tamping units transversely on the guide frame means relative to each other tamping unit.

The present invention has the advantage that it can achieve a complete tamping pattern rapidly and with more ease than has been heretofore possible, and without paying the price of the tamping depth problem of the pendulum type tamping head, solution. The present solution also has the advantage that when doing out of face tamping the tamping units may be spread the optimum amount to accommodate such variables as rail width and length of bolts at joint bars, etc.

According to one feature of the present invention each tamping unit is mounted on its own sub-frame, each sub- frame engaging the guide frame means to mount its associates tamping head thereon, the means for individually transversely moving the tamping units comprising individual power units connected between each sub-frame and the guide frame means.

Preferably, the means for individually raising and lowering the tamping units comprises an individual power unit connected between each tamping unit and its sub-frame to vertically move the tamping unit in its sub-frame.

According to a preferred aspect of the invention there is provided a self propelled railroad switch tamping machine comprising a wheeled rail travelling machine; guide frame means extending transversely of the vehicle and including upper and lower longitudinally and vertically spaced guideways; four individual sub-frames mounted on the guide frame means for horizontal displacement in translation thereon and engaging the upper and lower guideways; individual power means connected between each sub-frame and the guide frame means for individually moving each sub-frame on said guide frame means transversely of the vehicle and relative to each other sub-frame; a tamping unit mounted for vertical movement in each sub-frame, and individual power means connected between each tamping unit and its associated sub-frame to vertically move each tamping unit in its sub-frame relative to each other tamping unit.

BRIEF DESCRIPTION OF THE DRAWINGS

The following is a description by way of example of an embodiment of the present invention reference being had to the accompanying drawings in which.

DESCRIPTION OF THE PREFERRED EMBODIMENT

Figure 1:
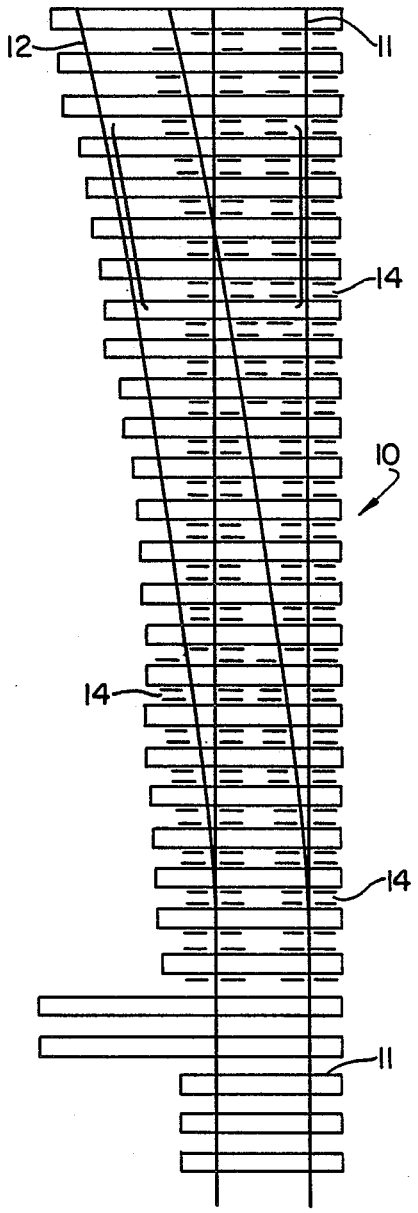
FIG. 1 PRIOR ART
FIG. 1 schematically illustrates a tamping pattern such as is produced by a pendulum type workhead.

In FIG. 1 there is shown a switch 10 in which a railroad track 11 divides into tracks 11 and 12, in standard fashion. A ballast tamping pattern is illustrated schematically by tamping tool marks 14. It will be clearly seen that a full tamping pattern is achieved in this instance. This tamping pattern is as a result of the operation of a track tamping machine with a pendulum type tamping head.

Figure 2:
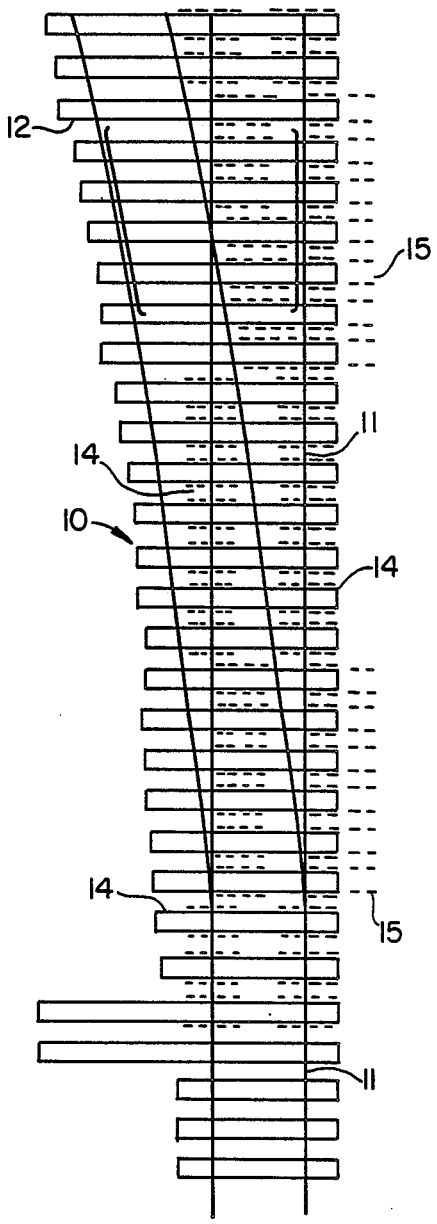
FIG. 2 PRIOR ART
FIG. 2 is a schematic tamping pattern of a conventional switch tamping machine with transversely horizontally movable tamping heads.

FIG. 2 again shows the same switch 10 but this time tamped with a conventional type tamping device in which the tamping heads are horizontally translatable on a transversely extending frame at the front of the tamping machine. Again the tamping pattern is illustrated by the tamping tool marks 14 and it will be seen that the pattern is somewhat less complete and that at certain areas, shown by the tamping tool marks 15, the tamping heads have been inserted into the shoulder ballast.

Figure 3:
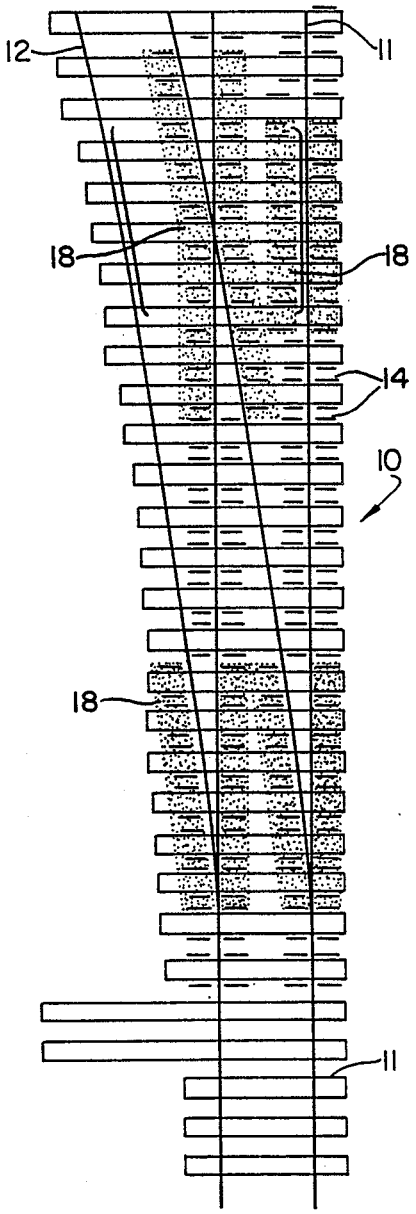
FIG. 3 PRIOR ART
FIG. 3 is a schematic representation of a tamping pattern achieved by a prior art machine in which the tamping heads are transversely movable horizontally of the track in a guideway with each tamping unit of the heads being capable of individual vertical movement.

FIG. 3 again shows the same switch 10 this time tamped with a tamping machine in which two workheads move horizontally on a transverse guide frame at the front of the switch tamping machine and in which each tamping workhead is made up of two units, each unit of each tamping head being vertically movable relative to the other unit in the tamping head. It will be seen that a complete tamping pattern is achieved but because of the nature of the switch, time consuming traversing and frequent operation of the individual tamping unit vertical actuators are required in certain areas. These areas, 18, are shaded.

Figure 4:
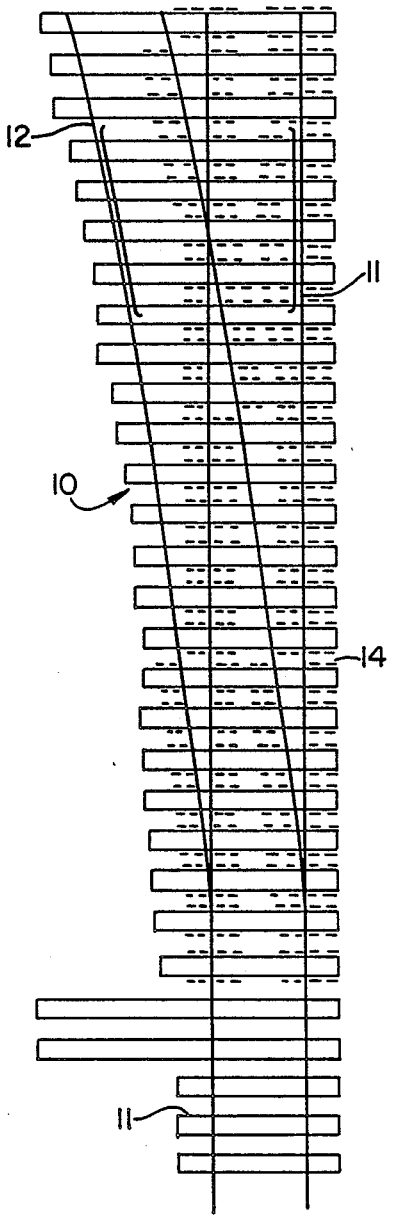
FIG. 4 is a schematic representation of a tamping pattern achieved by a device incorporating the present invention.

In FIG. 4 the same switch 10 is illustrated and the same convention is used. This Figure illustrates a tamping pattern produced by a device embodying the present invention and it will be seen that a complete tamping pattern is achieved and with efficient use of the switch tamping machine.

Figure 5:
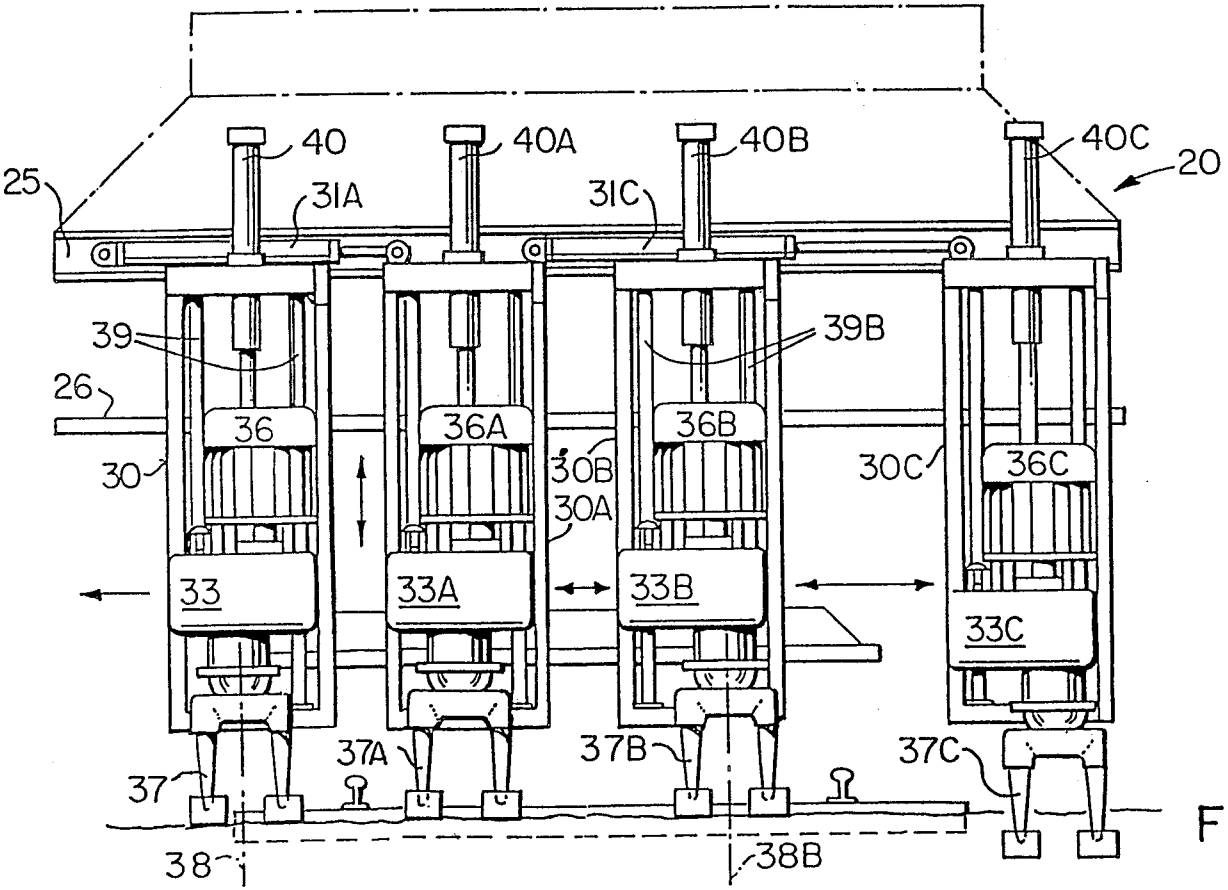
FIG. 5 is a somewhat schematic front view of a switch tamping machine incorporating the present invention.
Figure 6:
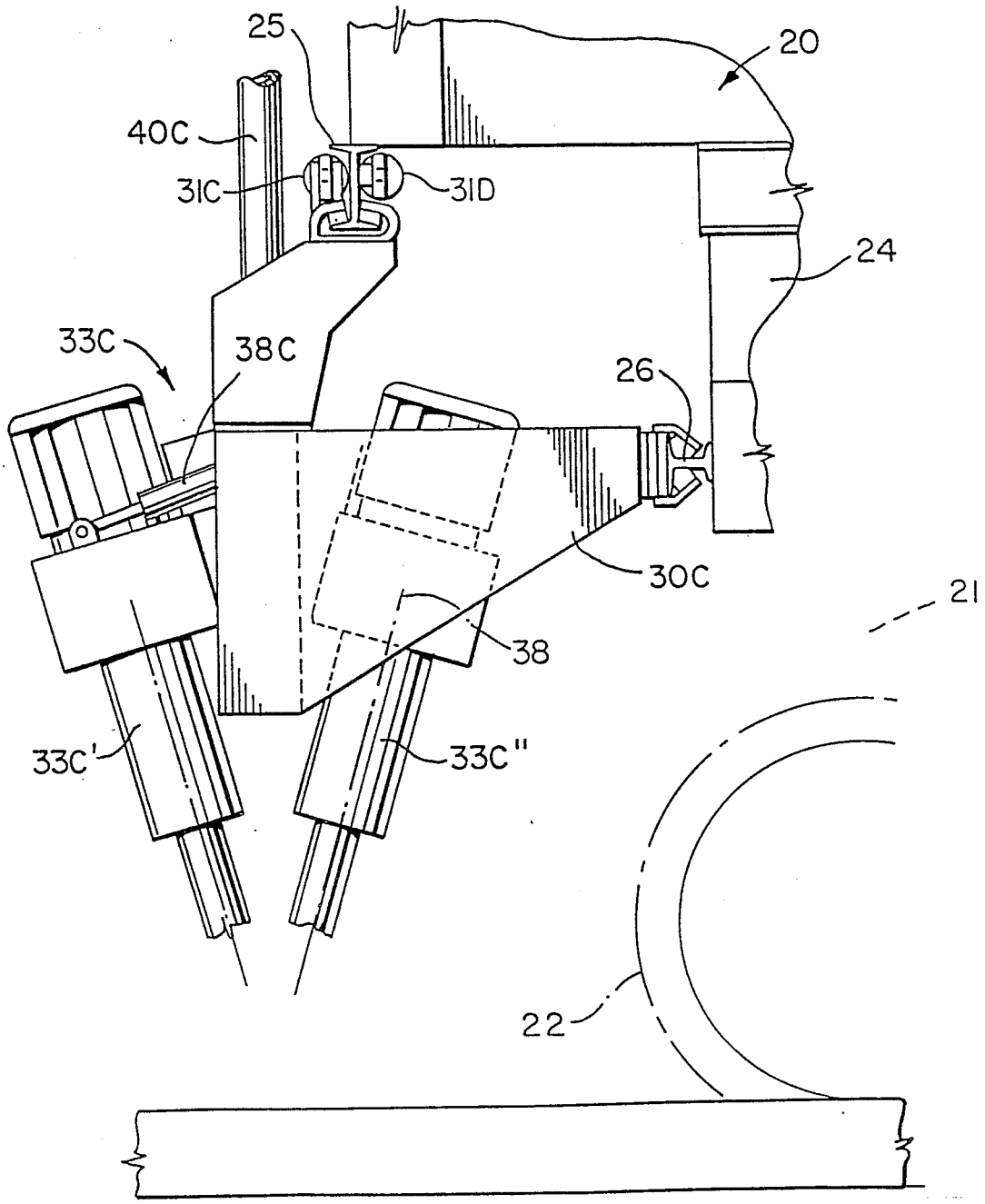
FIG. 6 is a schematic and side view of the tamping units and guide means of the machine illustrated in FIG. 5.

Turning now to FIGS. 5 and 6, a railroad track switch tamping machine 20 has a track travelling vehicle main frame 21 mounted on rail engaging wheels 22, in conventional fashion. At the front of the vehicle 21 is a transversely extending guide frame 24 having upper and lower guideways 25, 26 which are vertically displaced from each other and longitudinally displaced from each other as best seen in FIG. 6. Mounted in the guideways 25 and 26, on nylon slider pads, are four individual sub-frames 30, **30*a*, 30*b*, 30*c*. As seen in FIG. 5, sub-frame 30*a* is connected through a piston and cylinder hydraulic power means 31*a* to the guide frame means 24 and sub-frame 30*c* is connected by hydraulic piston and cylinder power means 31*c* arranged between sub-frame 30*c* and guide frame means 24. For the sake of simplicity, the piston and cylinder devices 31*a*, 30*c* are shown actually mounted on the guideway 25 but of course they could be connected to any suitable other part of the guide frame means 24. Hydraulic piston cylinder power means for the sub-frame 30 and the sub-frame 30*b* are provided at the rear of the arrangement shown in FIG. 5 and all four sub-frames 30, 30*a*, 30*b*, 30*c* are movable by their individual piston and cylinder means 31*a*, 31*c* etc. horizontally transversely of the tamping machine in translation on the guideways 25, 26, i.e. each point on the subframes is moved horizontally the same distance, and independently of, and separately from, one another. In FIG. 5 frame 30*c*** is shown moved to a position outboard of the machine proper.

Mounted on each of the sub-frames 30, **30*a*, 30*b*, 30*c* is an individual vibratory squeeze tamping unit 33, 33*a*, 33*b*, 33*c*. As best seen in FIG. 6, each tamping unit 33, 33*a*, 33*b*, 33*c* has front and rear elements 33*c*′ and 33*c*″. Each element of each tamping unit is vibrated by an electric motor 36 driving the tamping blades 37 so as to vibratory oscillate around a center line 38. This type of vibratory oscillating motion is well known in the art. The two elements of each unit are mounted so as to be squeezed in and out towards each other by means of squeeze cylinders such as diagrammatically illustrated by 38*c* in FIG. 6**. Again the action of squeezing vibratory oscillating tamping units to compact the ballast beneath ties is well known in the art.

Each tamping unit 33, **33*a*, 33*b*, 33*c* is mounted for vertical movement in guides 39 in the sub-frames 30, 30*a*, 30*b*, 30*c*. Individual hydraulic piston and cylinder power means 40 are provided individually to raise and lower vertically each tamping unit 33 on its guide bars 39 in its individual sub-frame independently of, and relative to every other tamping unit. In FIG. 5 tamping unit 33*c*** is shown lowered into the ballast.

By providing for individual and completely separate vertical and horizontal displacement of each tamping unit independently of every other tamping unit, a tamping pattern such as seen in FIG. 4 can be achieved, without the inherent drawbacks of previous proposals. The versatility achieved provides for a uniform tamping depth with a good tamping tool pattern, it is possible to tamp through a third rail switch and allow for variances in rail width and length of joint bar bolts and disturbance of the shoulder ballasts is avoided.

What I claim as my invention is:

1. A railroad switch tamping machine comprising a wheeled rail travelling vehicle;

guide frame means extending transversely of the vehicle;

four tamping units each with a ballast tamping blade mounted for movement in translation parallel to a plane containing the tops of the rails of a track and transversely to the length of the track and mounted for displacement on said guide frame means in a direction perpendicular to said plane;

means for individually moving each of the four tamping units in the direction of said displacement relative to each other tamping unit; and further means for individually moving each of the four tamping units on said guide frame means for causing said ballast tamping blades to be moved only in translation parallel to said plane and transversely to the length of the track and relative to each other tamping unit.

2. A switch tamping machine as claimed in claim 1 in which each tamping unit is mounted on its own sub-frame, each sub-frame engaging said guide frame means to mount its associated tamping unit thereon, said means for individually transversely moving said tamping units comprising individual power units connected between each sub-frame and said guide frame means.

3. A machine claimed in claim 2 in which said means for individually moving said tamping units comprises an individual power unit connected between each tamping unit and its sub-frame to move said tamping unit in its sub-frame in the direction of said displacement.

4. A self-propelled railroad switch tamping machine comprising a wheeled rail travelling vehicle;

guide frame means extending transversely of said vehicle, and including upper and lower longitudinally and vertically spaced guideways;

four individual sub-frames mounted on said guide frame means and engaging said upper and lower guideways for movement in translation thereon and parallel to a plane containing the tops of a track and transversely to the length of the track;

individual power means connected between each sub-frame and said guide frame means for individually moving each said sub-frame on said guide frame means longitudinally in translation parallel to said plane and transversely to the length of the track and relative to each other sub-frame;

a tamping unit mounted for movement in each sub-frame only in a direction perpendicular to said plane, and further individual power means connected between each tamping unit and its associated sub-frame to move each tamping unit in its sub-frame in said perpendicular direction relative to each other tamping unit.

5. A self-propelled railroad switch tamping machine comprising a wheeled rail travelling vehicle;

guide frame means extending transversely of said vehicle, and including guideways;

four individual sub-frames mounted on said guide frame means and engaging said guideways for movement in translation thereon and parallel to a plane containing the tops of a track and transversely to the length of the track;

individual power means connected between each sub-frame and said guide frame means for individually moving each said sub-frame on said guide frame means longitudinally in translation parallel to said plane and transversely to the length of the track and relative to each other sub-frame;

a tamping unit mounted for movement in each sub-frame only in a direction perpendicular to said plane, and further individual power means connected between each tamping unit and its associated sub-frame to move each tamping unit in its sub-frame in said perpendicular direction relative to each other tamping unit.

* * * * *